US005850585A

United States Patent [19]

Tsutsumi et al.

[11] Patent Number: 5,850,585

[45] Date of Patent: Dec. 15, 1998

[54] DESTATICIZER AND IMAGE FORMING APPARATUS EMPLOYING THE SAME

[75] Inventors: Masahiro Tsutsumi; Kazuhisa Edahiro; Yuichiro Hisakawa; Eiji Nimura; Hidekazu Shono, all of Osaka, Japan

[73] Assignee: Mita Industrial Co., Ltd., Japan

[21] Appl. No.: 950,996

[22] Filed: Oct. 15, 1997

[30] Foreign Application Priority Data

Oct. 16, 1996 [JP] Japan ..... 8-273718
Oct. 16, 1996 [JP] Japan ..... 8-273719

[51] Int. Cl.[6] ..... G03G 21/00; G03G 21/06

[52] U.S. Cl. ..... 399/128; 355/67; 355/71; 361/212

[58] Field of Search ..... 399/128, 186; 355/67, 70, 71; 361/212; 362/800

[56] References Cited

U.S. PATENT DOCUMENTS 4,413,897 11/1983 Kohyama ..... 399/128
4,785,324 11/1988 Yamazaki et al. ..... 399/128
4,827,306 5/1989 Tsujimoto et al. ..... 399/128
4,884,107 11/1989 Watanabe ..... 399/186 X
5,065,188 11/1991 Kobayashi et al. ..... 399/186
5,450,174 9/1995 Osbourne et al. ..... 399/186
5,639,158 6/1997 Sato ..... 355/70 X

*Primary Examiner*—William J. Royer
*Attorney, Agent, or Firm*—Rabin & Champagne P.C.

[57] ABSTRACT

A destaticizer which is adapted to remove electric charges from the surface of a photoreceptor by exposing the photoreceptor surface to light. The destaticizer includes a light source, and a light guide member for generally uniformly guiding light from the light source to a light exposure area on the photoreceptor. In accordance with one embodiment, the light guide member is an elongated member, which has an end face serving as a light receiving face for receiving the light emitted from the light source, a light transmitting path for transmitting the light received by the light receiving face, and a plurality of reflecting portions arranged along the length of the light guide member for reflecting the light transmitted through the light transmitting path in a direction intersecting the length of the light guide member.

14 Claims, 5 Drawing Sheets

DESTATICIZER AND IMAGE FORMING APPARATUS EMPLOYING THE SAME

BACKGROUND OF THE INVENTION

1. Field of the Invention

The present invention relates to a destaticizer for removing electric charges from the surface of a photoreceptor. The invention also relates to an image forming apparatus employing such a destaticizer.

2. Description of Related Art

Image forming apparatuses, such as copying machines and printers, adapted for electrophotographic image formation have a photoreceptor drum, a main charger for uniformly charging the surface of the photoreceptor drum, a developer unit for developing an electrostatic latent image formed on the surface of the photoreceptor drum into a toner image, a transfer charger for transferring the toner image on a sheet, and a cleaning unit for cleaning the photoreceptor drum after the image transfer. Some of the image forming apparatuses are provided with a destaticizer having a light emitting diode (LED) array including a multiplicity of LEDs aligned in a main scanning direction (along the longitudinal axis of the photoreceptor drum). The destaticizer is adapted to remove residual electric charges from the surface of the photoreceptor drum after the cleaning thereof by exposing the photoreceptor drum surface to light. Thus, the photoreceptor drum becomes ready for the subsequent image formation cycle.

Light emitting diodes have variations in luminous intensity and wavelength. Where the destaticization of a photoreceptor drum surface is achieved by means of an LED array, areas irradiated with the respective light emitting diodes have variations in luminous intensity and wavelength (see graphs indicated by one-dot-and-dash lines in FIGS. 4 and 5). Therefore, the photoreceptor drum may locally have portions where residual electric charges are not completely removed from the surface thereof or optical carriers are generated in excess in a photoreceptor layer thereof.

When the photoreceptor drum surface is subjected to a main charging process performed by the main charger in the subsequent image formation cycle, the uneven destaticization causes a variation in surface potential on the photoreceptor drum. Even if the photoreceptor drum surface is uniformly exposed to light after the main charging process, the photoreceptor drum has a variation in surface potential. This results in an uneven image density.

Particularly in the case of a photoreceptor drum formed of amorphous silicon, the variations in luminous intensity and wavelength of the light emitting diodes significantly influence the charging performance of the main charger.

One approach to reduction of the variations in luminous intensity and wavelength is to selectively use light emitting diodes having similar luminous intensities and wavelengths. However, the selection of such light emitting diodes is troublesome, resulting in an increased cost.

Another approach is to control the luminous intensity of each of the light emitting diodes by controlling a voltage to be applied thereto. However, the control of the voltage application requires resistors having different resistances for the respective light emitting diodes, resulting in an increased cost.

SUMMARY OF THE INVENTION

It is an object of the present invention to provide a destaticizer which offers excellent destaticizing performance.

It is another object of the present invention to provide an image forming apparatus which ensures image formation free from image density unevenness.

A destaticizer according to the present invention has a light guide member for generally uniformly guiding light from a light source to a light exposure area on a photoreceptor. Thus, the intensity of the light (or the amount of the light) outputted from the light guide member is made uniform in the light exposure area. Even if the destaticizer has a plurality of light sources which emit light beams having different wavelengths, the light outputted from the light guide member does not have locally different wavelengths. Therefore, when destaticized by this destaticizer, the surface of the photoreceptor does not suffer uneven destaticization which may otherwise be caused due to variations in intensity and wavelength of light emitted onto the photoreceptor surface.

The light guide member may be an elongated member which has an end face serving as a light receiving face for receiving the light emitted from the light source, a light transmitting path for transmitting the light received by the light receiving face, and a plurality of reflecting portions for reflecting the light transmitted through the light transmitting path in a direction intersecting the length of the light guide member.

With this arrangement, the light entering the light receiving face of the light guide member from the light source is transmitted through the light guide member, then reflected on the reflecting portions, and outputted in the direction intersecting the length of the light guide member. Thus, .a surface portion of the photoreceptor within the light exposure area linearly extending along the length of the light guide member can uniformly be exposed to the light for destaticization thereof.

The light guide member may include a plurality of twisted optical fibers. In such a case, one-end portions of the plurality of optical fibers are preferably bundled into a shape such that the light emitted from the light source can readily be incident therein, and the other-end portions of the plurality of optical fibers are aligned in a predetermined direction.

With this arrangement, the light emitted from the light source to one end of the light guide member is transmitted through the optical fibers and outputted from the other end of the light guide member. Middle portions of the plurality of optical fibers are twisted so that the light outputted from the optical fibers is uniform even if the respective optical fibers receive different light amounts, and the light outputting end portions thereof are aligned. Therefore, when the photoreceptor surface is destaticized by the destaticizer, there is no variation in the intensity of the light emitted toward the photoreceptor, so that the photoreceptor surface does not suffer uneven destaticization.

Even if a plurality of light sources are provided, light having locally different wavelengths is not emitted from the light guide member. Therefore, the uneven destaticization of the photoreceptor surface, which may otherwise be caused due to variations in the wavelength of the light.

Thus, a surface portion of the photoreceptor can uniformly be destaticized within the light exposure area linearly extending along the arrangement of the other-end portions of the plurality of optical fibers.

The light source may be adapted to emit two kinds of light beams, one of which has a greater wavelength than the other. With this arrangement, a long-wavelength light beam and a short-wavelength light beam are uniformly emitted from the light guide member.

The destaticizer with this arrangement is particularly suitable for a photoreceptor having a photoconductive layer formed of amorphous silicon. Electric charges on the photoreceptor surface which are not removed by irradiation with the short-wavelength light beam can be removed by irradiation with the long-wavelength light beam. Thus, the photoreceptor surface can be satisfactorily destaticized even with a small light amount. In comparison with a case where only the long-wavelength light beam is used for the destaticization, the fatigue of the photoreceptor is alleviated so that the lifetime of the photoreceptor can be extended.

The light source may be adapted to emit a light beam including a light component having a wavelength of 650 nm or greater.

Where a small number of light, can be prevented emitting diodes are employed as the light source and light beams from the light emitting diodes are guided through the light guide member to the light exposure area on the photoreceptor, for example, the amount of the light to be outputted from the light guide member is reduced in comparison with a conventional destaticizer employing a LED array. This may result in an inconvenience such that electric charges on the photoreceptor surface are not completely removed. To output a light amount equivalent to that emitted from the LED array of the conventional destaticizer, the light emitting diodes to be employed should be of the type which can emit a large amount of light. This leads to an increase in the cost of the destaticizer.

For this reason, the light source is adapted to emit the aforesaid specific light which includes the light component having a wavelength of 650 nm or greater, whereby residual electric charges can assuredly be removed from the photoreceptor surface even if the light amount is small. When the photoreceptor surface is subjected to a main charging process performed by a main charger in the subsequent image forming process, the photoreceptor surface is uniformly charged at a predetermined potential, so that an image to be formed on a sheet is free from density unevenness.

Further, the destaticization with the light including the light component having a wavelength of 650 nm or greater reduces the power consumption because only a small light amount is required. In addition, the surface potential of the photoreceptor is not excessively reduced because the light amount required for the destaticization is small. This eliminates an inconvenience such that the main charger fails to charge the photoreceptor surface at a desired high potential.

The foregoing and other objects, features and effects of the present invention will become more apparent from the following description of the preferred embodiments with reference to the attached drawings.

DESCRIPTION OF THE PREFERRED EMBODIMENTS

Figure 1:
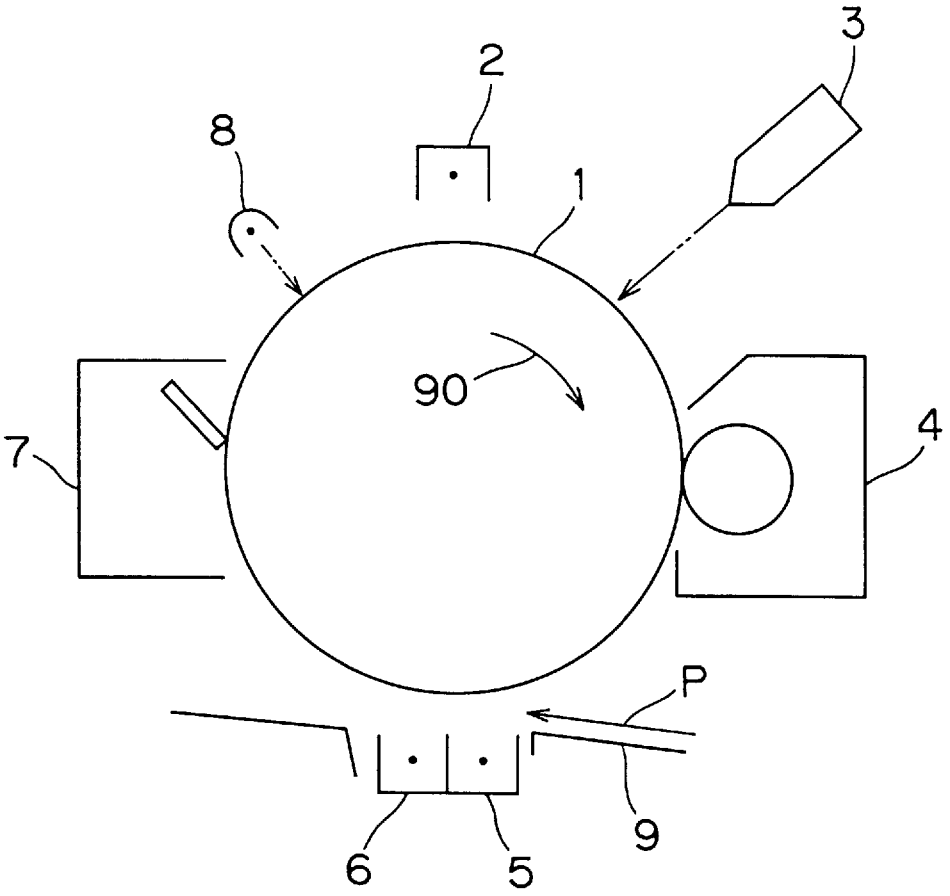
FIG. 1 is a diagram schematically illustrating the construction of an image forming apparatus provided with a destaticizer.

FIG. 1 is a diagram schematically illustrating the construction of an image forming apparatus provided with a destaticizer according to a first embodiment of the present invention, more specifically the construction of an image forming section thereof.

The image forming section has a photoreceptor drum 1 adapted to rotate at a constant speed in the direction of an arrow 90. A main charger 2, an exposure unit 3, a developer unit 4, a transfer charger 5, a separation charger 6 and a cleaning unit 7 are provided around the photoreceptor drum 1 in this order in the direction 90 of the rotation thereof. Between the cleaning unit 7 and the main charger 2 is provided a destaticizer 8.

When facing opposite to the main charger 2, the surface of the photoreceptor drum 1 is uniformly charged at a predetermined potential by the discharge of the main charger 2. As the photoreceptor drum 1 is rotated, a uniformly charged surface portion of the photoreceptor drum faces opposite to the exposure unit 3. The exposure unit 3 exposes the surface of the photoreceptor drum 1 to light emitted on the basis of data of an image to be formed. Thus, electric charges on the exposed surface portions of the photoreceptor drum are removed, so that high potential portions and low potential portions are formed on the surface of the photoreceptor drum 1 for formation of a so-called electrostatic latent image.

When a surface portion of the photoreceptor drum bearing the electrostatic latent image formed thereon faces opposite to the developer unit 4, the electrostatic latent image is developed into a toner image. As the photoreceptor drum 1 is further rotated, the leading edge of the toner image faces opposite to the transfer charger 5. In synchronization therewith, a sheet P is supplied through a transportation path 9 from a sheet feeder not shown. The sheet P passes between the photoreceptor drum 1 and the transfer charger 5. At this time, toner adhering onto the surface of the photoreceptor drum 1 is transferred onto the sheet P by the discharge of the transfer charger 5, and adheres onto a surface of the sheet P.

The sheet P bearing the toner image thus transferred thereon is separated from the surface of the photoreceptor drum 1 by the discharge of the separation charger 6, and then led to a fixing unit not shown so as to be subjected to a fixing process for fixing toner particles thereon. After the fixing process, the sheet P is discharged outside the apparatus.

In general, part of the toner is not transferred onto the sheet P but remains on the surface of the photoreceptor drum 1 after the separation of the sheet P. As the photoreceptor drum 1 is further rotated, a surface portion of the photoreceptor drum 1 faces opposite to the cleaning unit 7, and residual toner adhering thereon is removed by the cleaning unit 7.

After the removal of the residual toner, the photoreceptor drum 1 has a nonuniform surface potential because of influences by the aforesaid processes. In other words, electric charges locally remain on the surface of the photoreceptor drum 1 after the cleaning process. If the subsequent image forming operation were performed in this state, the surface of the photoreceptor drum 1 could not be uniformly charged by the discharge of the main charger 2, so that an undesirable image would be formed on a sheet. For this reason, the surface of the photoreceptor drum 1 is exposed to light by means of the destaticizer 8 for removal of the residual electric charges after the cleaning process.

One cycle of the image forming process is performed in the manner described above.

Figure 2:
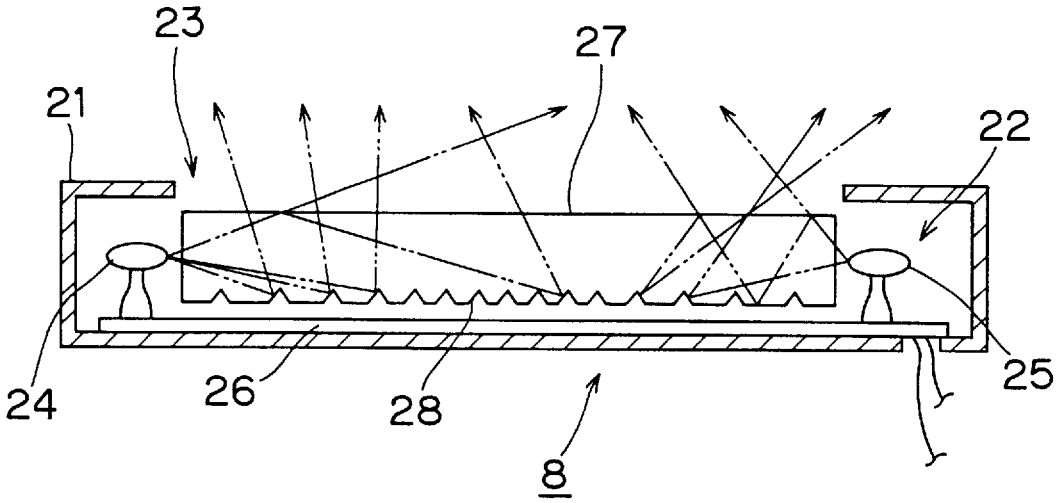
FIG. 2 is a sectional view of a destaticizer according to first and second embodiments taken along a line extending parallel to the longitudinal axis of a photoreceptor drum.
Figure 3:
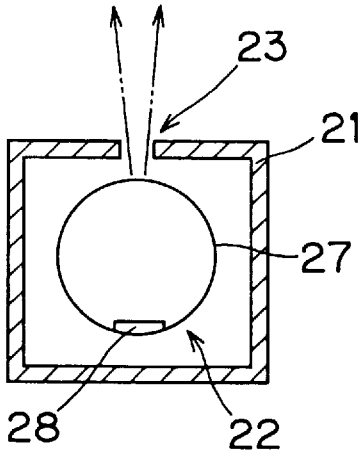
FIG. 3 is a sectional view of the destaticizer taken along a line extending perpendicular to the longitudinal axis of the photoreceptor drum.

FIG. 2 is a sectional view of the destaticizer 8 taken along a line extending parallel to the longitudinal axis of the photoreceptor drum 1. FIG. 3 is a sectional view of the destaticizer 8 taken along a line extending perpendicular to the longitudinal axis of the photoreceptor drum 1.

The destaticizer 8 has a light-shielding housing 21 and a light emitting unit 22 housed in the housing 21. The housing 21 has a rectangular parallelopiped shape with its longitudinal axis extending parallel to the longitudinal axis of the photoreceptor drum 1 (see FIG. 1), and has a housing space therein for housing the light emitting unit 22. The housing 21 further has a slit-like illumination window 23 formed in a face thereof confronting the photoreceptor drum 1 (a top face thereof in FIGS. 2 or 3) and extending along the length of the housing 21. Light emitted from the light emitting unit 22 is outputted through the illumination window 23 from the housing 21, and the surface of the photoreceptor drum 1 is exposed to the light. That is, a surface portion of the photoreceptor drum 1 to be exposed to the light outputted through the illumination window 23 is a light exposure area. In this embodiment, the light exposure area linearly extends along the longitudinal axis of the photoreceptor drum 1.

The light emitting unit 22 includes light emitting diodes 24 and 25 (hereinafter referred to as "LEDs 24 and 25") disposed at longitudinally opposite sides of the housing 21, a printed circuit board 26 formed with a conductive pattern for applying predetermined voltages to the LEDs 24 and 25, and a light guide member 27 of an elongate bar shape disposed between the LEDs 24 and 25. Although the printed circuit board 26 is provided in the housing 21 to apply the voltages to the LEDs 24 and 25 in this embodiment, the printed circuit board 26 is not necessarily required. The LEDs 24 and 25 may be connected directly to a power supply (not shown) provided in the image forming apparatus.

The light guide member 27 is formed of a transparent material such as an acrylic resin. Therefore, when light is emitted from the LEDs 24 and 25 to opposite ends of the light guide member 27 serving as light receiving faces, the light is transmitted through the light guide member 27. The inside of the light guide member 27 serves as a light transmission path.

The light guide member 27 has a multiplicity of reflecting portions 28 formed on the circumference thereof for reflecting the light propagating within the light guide member 27 and leading the light to the illumination window 23 of the housing 21. More specifically, the multiplicity of reflecting portions 28 are each formed by cutting a portion of the circumference of the light guide member 27 into a recess having a generally V-shaped cross section, and aligned along the length of the light guide member 27 as shown in FIG. 2. The V-shaped recesses of the reflecting portions 28 are each provided in a position on the circumference of the light guide member 27 opposite to the illumination window 23 and extend in a direction perpendicular to the length of the light guide member 27. The light propagating within the light guide member 27 is reflected on slant surfaces of the reflecting portions 28 as shown by a two-dot-and-dash line in FIG. 2, and outputted in a direction intersecting the length of the light guide member 27.

The multiplicity of reflecting portions 28 are arranged so that a spacing between each two adjacent reflecting portions 28 is relatively large in the vicinity of the opposite ends of the light guide member 27 and decreases with a decrease in the distance from the middle of the light guide member 27. In the vicinity of the opposite ends (the light receiving faces) of the light guide member 27, the amount of light propagating in the light guide member 27 is relatively large. As the light propagates closer to the middle of the light guide member 27, the light is scattered so that the light amount is reduced. The aforesaid arrangement of the plurality of reflecting portions 28 makes it possible to output uniform light from every portion of the light guide member 27 toward the illumination window 23. If a difference between the light amount in the vicinity of the light receiving faces and the light amount at the middle of the light guide member 27 is negligible, the reflecting portions 28 may be equidistantly arranged.

Figure 4:
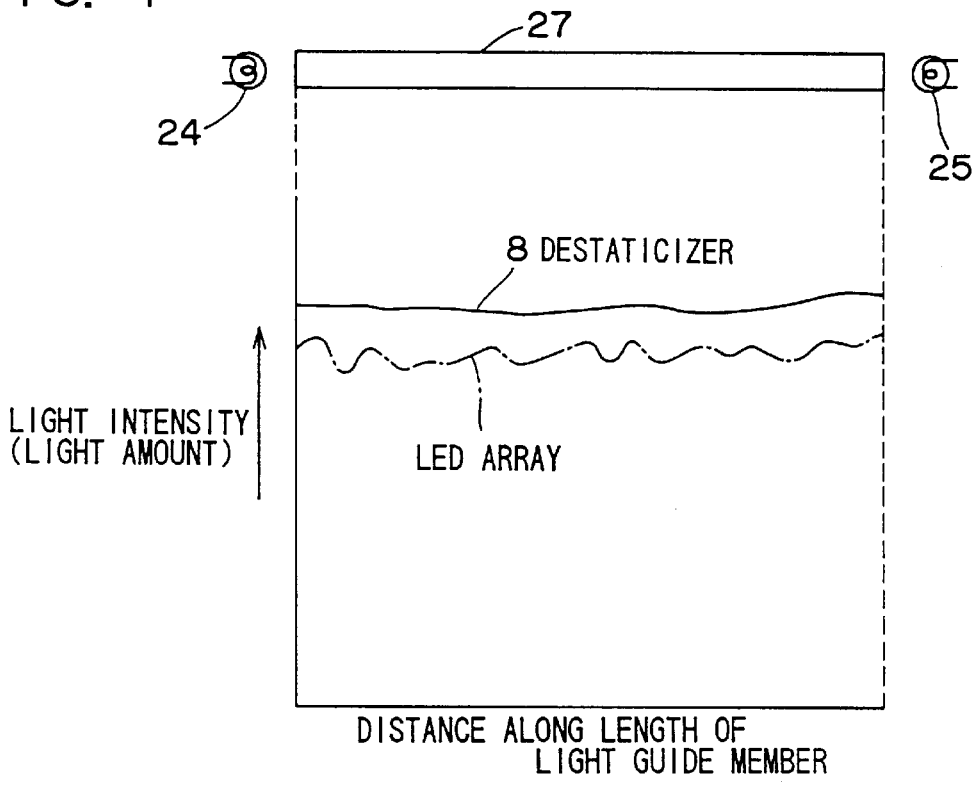
FIG. 4 is a graphical representation illustrating the intensity distribution of light emitted from the destaticizer.

As described above, with the use of the destaticizer 8, the light beams emitted from the two LEDs 24 and 25 are transmitted through the light guide member 27, reflected on the reflecting portions 28, and uniformly outputted from the entire light guide member toward the photoreceptor drum 1 (see FIG. 1). Even if the LEDs 24 and 25 have slightly different luminous intensities, the intensities of the light beams outputted from the light guide member 27 are generally constant regardless of the light outputting position along the light guide member 27. More specifically, the intensity distribution of the light outputted from the light guide member 27 as shown by a solid line in FIG. 4 has a smaller variation than the intensity distribution of the light emitted from a LED array shown by a one-dot-and-dash line in FIG. 4. Therefore, uneven destaticization of the surface of the photoreceptor drum 1 can be prevented which may otherwise be caused due to variations in the intensity of the light.

Figure 5:
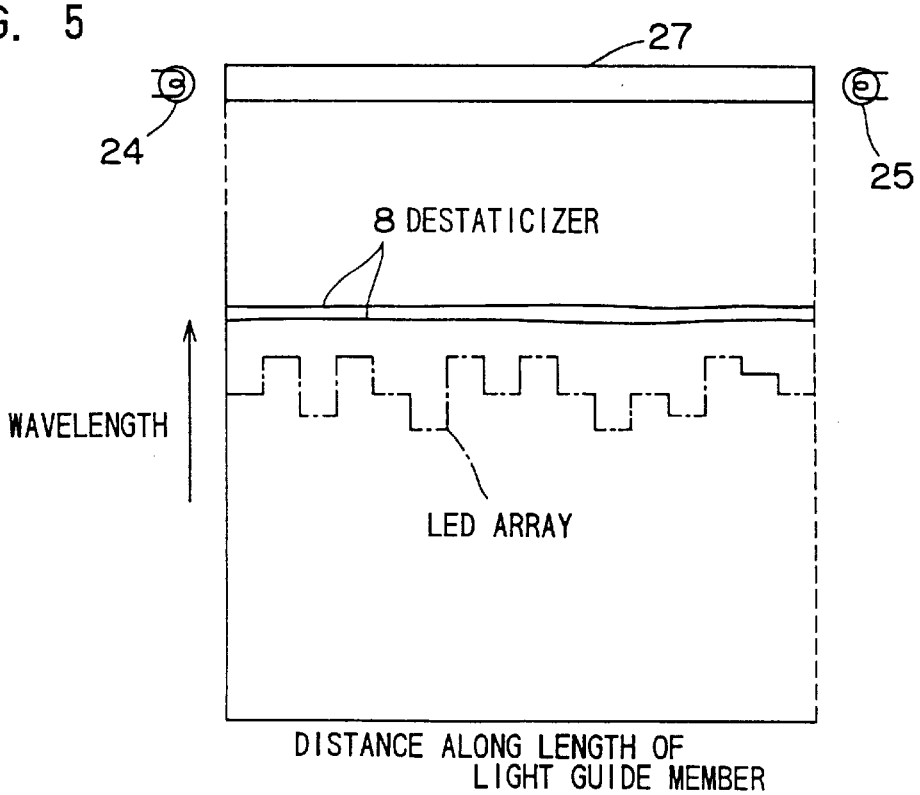
FIG. 5 is a graphical representation illustrating the wavelength distribution of light emitted from the destaticizer.

Even if the LEDs 24 and 25 have different light wavelengths, the light beams emitted from the LEDs 24 and 25 are reflected by the light guide member 27 to be uniformly outputted from the entire light guide member 27 as shown by a solid line in FIG. 5. This eliminates an inconvenience such that the wavelength of a light beam emitted onto the surface of the photoreceptor drum varies depending on the illumination area of each light emitting diode in the LED array as shown in FIG. 5. Therefore, uneven destaticization of the surface of the photoreceptor drum 1 can be prevented which may otherwise be caused due to variations in the wavelength of the light.

Where light emitting diodes adapted to emit light beams having substantially the same wavelengths are employed as the LEDs 24 and 25, the surface of the photoreceptor drum 1 can be irradiated with light of a single wavelength. In this case, light emitting diodes adapted to emit light beams having substantially the same wavelength should selectively be used, but the selection of such light emitting diodes is easier than in a case where an LED array comprising a multiplicity of light emitting diodes is used.

Since the destaticizer 8 prevents the uneven destaticization of the surface of the photoreceptor drum 1, the surface of the photoreceptor drum 1 is uniformly charged at a predetermined potential when the photoreceptor drum surface is subjected to the main charging process performed by the main charger 2 in the subsequent image formation process. Therefore, the image formed on the sheet is free from density unevenness.

Where a photoconductive layer on the circumference of the photoreceptor drum 1 is formed of an amorphous silicon photoconductive material, it is preferred that the light to be emitted from the LED 24 has a greater wavelength than the light to be emitted from the LED 25. Conversely, the light to be emitted from the LED 25 may have a greater wavelength than the light to be emitted from the LED 24.

It is generally known that, when a amorphous silicon photoreceptor drum is destaticized by irradiation with a small amount of short-wavelength light (e.g., 550 nm or smaller), electric charges undesirably remain on the photoreceptor drum surface. However, use of a greater amount of light for the destaticization is not preferred because power consumption and running costs are increased. On the other hand, use of long-wavelength light (e.g., 600 nm or greater) even in a small amount ensures satisfactory destaticization. However, the destaticization only with the long-wavelength light results in a problem such that fatigue of the photoreceptor drum caused during repeated use thereof makes it impossible to charge the photoreceptor drum surface at a desired high potential by the main charger 2.

For this reason, the LEDs 24 and 25 are adapted to emit a long-wavelength light beam and a short-wavelength light beam, respectively, so that electric charges which cannot be removed by irradiation with the short-wavelength light beam can be removed by irradiation with the long-wavelength light beam. Thus, the surface of the photoreceptor drum 1 can be satisfactorily destaticized without increasing the power consumption. In comparison with the destaticization only with the long-wavelength light beam, the fatigue of the photoreceptor drum 1 is alleviated thereby to extend the lifetime of the photoreceptor drum 1.

A second embodiment of the present invention will next be described. This embodiment is characterized by the wavelengths of the light beams emitted from the LEDs 24 and 25, and the other features thereof are the same as those in the first embodiment. In the following description, FIG. 1 and the like are referred to again.

This embodiment is advantageously applied to a case where the photoreceptor drum 1 has a photoconductive layer formed of amorphous silicon on the circumference thereof.

In the case of the photoreceptor drum of amorphous silicon, the wavelength and amount of light emitted from the destaticizer significantly influence the destaticization state and the charging performance of the main charger in the subsequent image formation process.

More specifically, if the photoreceptor drum surface is destaticized with a small amount of light having a certain wavelength, an inconvenience may be caused such that electric charges undesirably remain on the photoreceptor drum surface and an undesired image is formed in the subsequent image formation process. This is generally referred to as "image memory phenomenon". The inconvenience can be eliminated by using a greater amount of light for the destaticization. However, the use of a greater light amount is not preferred because the power consumption and the running costs of the destaticizer are increased. In addition, the use of an excessively large amount of light for the destaticization results in an excessively low surface potential of the photoreceptor drum, making it impossible to charge the photoreceptor drum surface at a desired high potential by the main charger. Therefore, the minimum amount of light is preferably used for the destaticization.

The inventors of the present invention have made efforts to find a way of sufficiently removing residual charges from the surface of the photoreceptor drum 1 by irradiation with a small amount of light. The inventors performed an experiment in which the photoreceptor drum 1 of amorphous silicon was irradiated with light beams having different wavelengths to determine the amount of light which ensured sufficient removal of the residual electric charges from the surface of the photoreceptor drum 1. As a result, it was found that the image memory phenomena occurred in a hatched area in a graph of FIG. 6.

Figure 6:
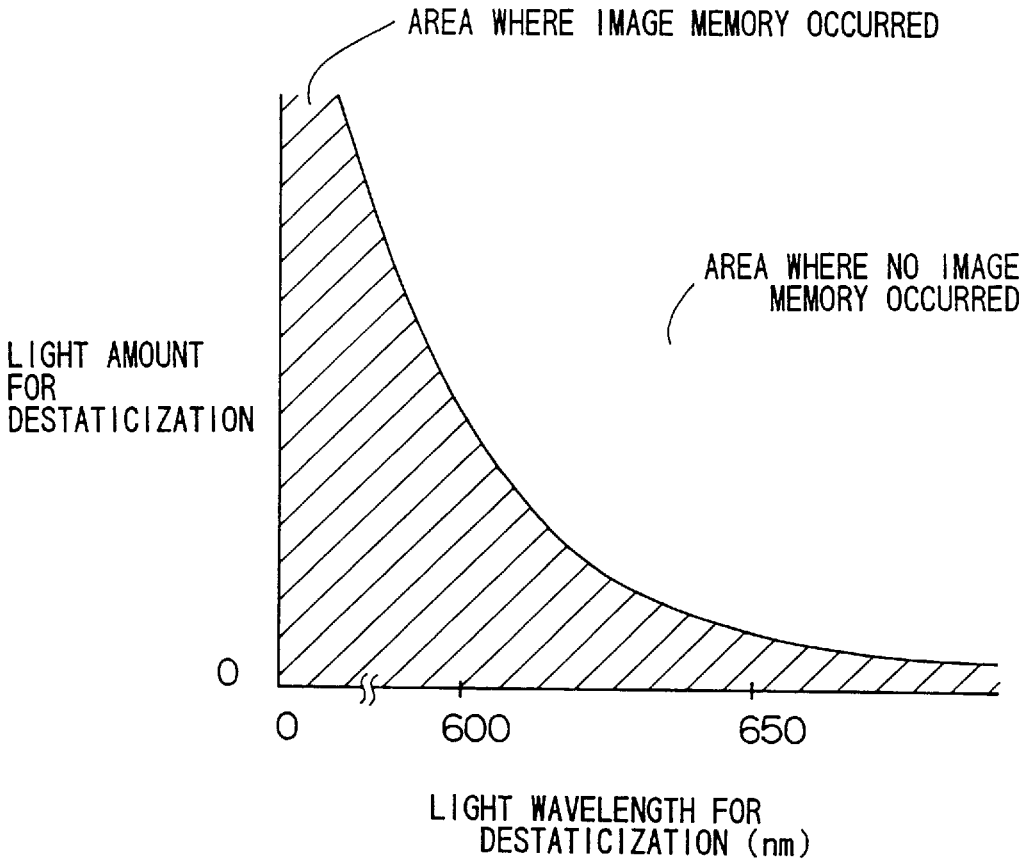
FIG. 6 is a graphical representation illustrating a relationship between the destaticizing light wavelength and the destaticizing light amount which ensures complete removal of residual electric charges from the surface of the photoreceptor drum.

As apparent from FIG. 6, it is preferred that the long-wavelength light beam is used for sufficient destaticization with a smaller light amount. The inventors concluded on the basis of the experiment result that the light beams emitted from the LEDs 24 and 25 preferably each have a wavelength D satisfying the following expression:

$$D \geqq 650 \text{ (nm)}$$

It is noted that this conclusion was derived from a particular case where the length of the photoreceptor drum 1 (as measured along the longitudinal axis thereof) was substantially equal to the length of an A4 sheet and the length of the light guide member 27 provided in the destaticizer 8 is substantially equal to the length of the photoreceptor drum 1.

In this embodiment, the LEDs 24 and 25 provided in the destaticizer 8 are each adapted to emit light having a wavelength of $D \geqq 650$ (nm).

In accordance with this embodiment, uneven destaticization of the surface of the photoreceptor drum 1 can be prevented, and the residual electric charges can satisfactorily be removed from the surface of the photoreceptor drum 1 by irradiation with a small amount of light as in the first embodiment. Therefore, when the surface of the photoreceptor drum 1 is subjected to the main charging process performed by the main charger 2 in the subsequent image forming process, the photoreceptor drum surface is uniformly charged at a predetermined potential, so that an image to be formed on a sheet is free from density unevenness.

Further, this embodiment does not suffer an increased power consumption nor an excessively reduced photoreceptor surface potential, which would otherwise result when a greater amount of light is used for the destaticization. This obviates an inconvenience such that the main charger 2 fails to charge the photoreceptor drum surface at a desired high potential in the subsequent image forming process.

Although the first and second embodiments employ two light emitting diodes which are provided at the opposite ends of the light guide member 27, the arrangement of the light emitting diodes is not limited thereto. For example, the arrangement may be such that a single light emitting diode is provided at one end and a plurality of light emitting diodes are provided at the other end, or such that a plurality of light emitting diodes are provided at each end.

Alternatively, a single light emitting diode or a plurality of light emitting diodes are provided only at one end of the light guide member 27. In such a case, for uniform light scattering from the light guide member 27, the reflecting portions 28 in the light guide member 27 are preferably arranged so that the spacing between each two adjacent reflecting portions 28 decreases as the distance from the light emitting diodes increases.

Figure 7:
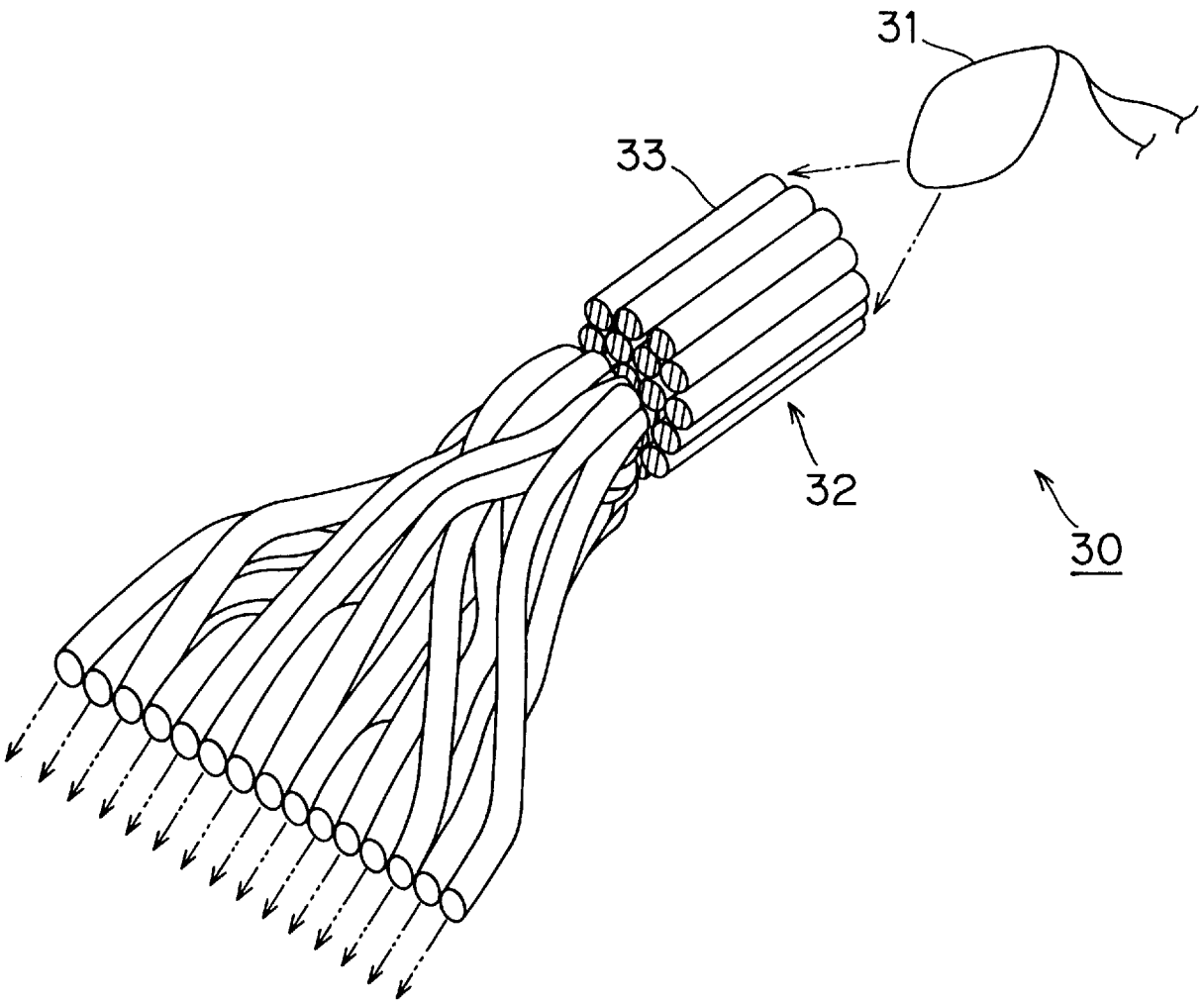
FIG. 7 is a perspective view illustrating a destaticizer according to a third embodiment.

FIG. 7 is a perspective view illustrating a destaticizer 30 according to a third embodiment of the present invention. The destaticizer 30 can be used in place of the destaticizer 8 described above.

The destaticizer 30 includes a light emitting diode 31 (hereinafter referred to as "LED 31"), and a light guide member 32 for guiding light from the LED 31 to the surface of the photoreceptor drum 1. The light guide member 32 includes a plurality of optical fibers 33, for example. One-end portions of the plurality of optical fibers are bundled so that one end of the bundle is irradiated with the light emitted from the LED 31. The middle portions of the plurality of optical fibers 33 are twisted so that a surface portion of the photoreceptor drum 1 can uniformly be irradiated with the light even if the respective optical fibers receive different amounts of light. Light outputting end faces of the optical fibers 33 which face to the surface of the photoreceptor drum 1 are aligned along the longitudinal axis of the photoreceptor drum 1. An area on the surface of the photoreceptor drum 1 which faces opposite to the end faces of the plurality of optical fibers 33 thus aligned is a light exposure area.

Since the amount of the light emitted toward the photoreceptor drum 1 is uniform across the length of the photoreceptor drum 1, the photoreceptor drum 1 does not suffer uneven destaticization due to variations in light amount. In addition, the use of the single LED 31 prevents uneven destaticization due to variations in light wavelength.

A plurality of light emitting diodes may be used in the destaticizer 30. Particularly where the photoreceptor drum 1 is formed of amorphous silicon, light emitting diodes respectively adapted to emit a long-wavelength light beam and a short-wavelength light beam may be used, whereby electric charges which cannot be removed by irradiation with the short-wavelength light beam can be removed by irradiation with the long-wavelength light beam. Thus, the surface of the photoreceptor drum 1 can satisfactorily be destaticized without increasing the power consumption. In comparison with the destaticization by irradiation only with the long-wavelength light beam, the fatigue of the photoreceptor drum 1 is alleviated thereby to extend the lifetime of the photoreceptor drum 1.

Further, the construction of the second embodiment may be applied to this embodiment, whereby the LED 31 is adapted to emit a light beam having a wavelength of 650 nm or greater.

While the present invention has been thus described by way of embodiments thereof, the invention is not limited to these embodiments. Although the explanation for the aforesaid embodiments is directed to a case where the destaticizer is used to remove residual electric charges from the surface of the photoreceptor drum after the cleaning thereof, the destaticizer may be used as a pre-transfer lamp (PTL) to be provided between the developer unit and the transfer charger for improvement of the efficiency of toner transfer by the transfer charger, or as an after-transfer lamp (ATL) to be provided between the separation charger and the cleaning unit for improvement of the cleaning performance. Alternatively, the destaticizer may be provided between the developer unit and the transfer charger and adapted to emit light in synchronization with the discharge of the transfer charger for improvement of the transfer efficiency.

Further, the photoreceptor provided in the image forming apparatus is of a drum type in the aforesaid embodiments, but the photoreceptor is not limited to the drum type. For example, the photoreceptor may be of an endless belt type and the like.

While the present invention has been described in detail by way of the embodiments thereof, it should be understood that the foregoing disclosure is merely illustrative of the technical principles of the present invention but not limitative of the same. The spirit and scope of the present invention are to be limited only by the appended claims.

This application claims priority benefits under 35 USC Section 119 based on of Japanese Patent Applications No. 8-273718 and No. 8-273719 filed on Oct. 16, 1996 in the Japanese Patent Office, the disclosure thereof being incorporated herein by reference.

What is claimed is:

1. A destaticizer for removing electric charges from a surface of a photoreceptor by exposing the photoreceptor surface to light, the destaticizer comprising:

a light source; and a light guide member for generally uniformly guiding light from the light source to a light exposure area on the photoreceptor;

wherein the light guide member is an elongated member which has an end face serving as a light receiving face for receiving light emitted from the light source, a light transmitting path for transmitting the light received by the light receiving face, and a plurality of reflecting portions arranged along the length of the light guide member for reflecting the light transmitted through the light transmitting path in a direction intersecting the length of the light guide member.

2. A destaticizer as set forth in claim 1, wherein the plurality of reflecting portions are arranged so that a spacing between each two adjacent reflecting portions is greater in the vicinity of a longitudinal end of the light guide member than in a longitudinally middle portion of the light guide member.

3. A destaticizer as set forth in claim 1, wherein the reflecting portions are each formed by cutting a portion of the light guide member into a V-shaped recess.

4. A destaticizer for removing electric charges from a surface of a photoreceptor by exposing the photoreceptor surface to light, the destaticizer comprising:

a light source; and a light guide member for generally uniformly guiding light from the light source to a light exposure area on the photoreceptor;

wherein the light guide member includes a plurality of twisted optical fibers, one-end portions of the plurality of optical fibers being bundled into a shape such that the light emitted from the light source can readily be incident therein, the other-end portions of the plurality of optical fibers being aligned in a predetermined direction.

5. A destaticizer for removing electric charges from a surface of a photoreceptor by exposing the photoreceptor surface to light, the destaticizer comprising:

a light source adapted to emit two different kinds of light beams, one kind of which has a greater wavelength than the other; and a light guide member for generally uniformly guiding light from the light source to a light exposure area on the photoreceptor.

6. A destaticizer as set forth in claim 5, wherein the light beam of the one kind has a wavelength of 550 nm or smaller and the light beam of the other kind has a wavelength of 600 nm or greater.

7. A destaticizer for removing electric charges from a surface of a photoreceptor by exposing the photoreceiptor surface to light, the destaticizer comprising:

a light source adapted to emit light including a light component having a wavelength of 650 nm or greater; and a light guide member for generally uniformly guiding light from the light source to a light exposure area on the photoreceptor.

8. An image forming apparatus comprising:

a photoreceptor;

a main charger for charging a surface of the photoreceptor at a predetermined potential;

a cleaning unit for removing residual toner adhering onto the photoreceptor surface; and a destaticizer for removing electric charges from the photoreceptor surface, the destaticizer being adapted to remove electric charges from the photoreceptor surface by exposing the photoreceptor surface to light, and having a light source and a light guide member for generally uniformly guiding light from the light source to a light exposure area on the photoreceptor;

wherein the light guide member is an elongated member which has an end face serving as a light receiving face for receiving the light emitted from the light source, a light transmitting path for transmitting the light received by the light receiving face, and a plurality of reflecting portions arranged along the length of the light guide member for reflecting the light transmitted through the light transmitting path in a direction intersecting the length of the light guide member.

9. An image forming apparatus as set forth in claim 8, wherein the plurality of reflecting portions are arranged so that a spacing between each two adjacent reflecting portions is greater in the vicinity of a longitudinal end of the light guide member than in a longitudinally middle portion of the light guide member.

10. An image forming apparatus comprising:

a photoreceptor;

a main charger for charging a surface of the photoreceptor at a predetermined potential;

a cleaning unit for removing residual toner adhering onto the photoreceptor surface; and a destaticizer for removing electric charges from the photoreceptor surface, the destaticizer being adapted to remove electric charges from the photoreceptor surface by exposing the photoreceptor surface to light, and having a light source and a light guide member for generally uniformly guiding light from the light source to a light exposure area on the photoreceptor;

wherein the light guide member includes a plurality of twisted optical fibers, one-end portions of the plurality of optical fibers being bundled into a shape such that the light emitted from the light source can readily be incident therein, the other-end portions of the plurality of optical fibers being aligned in a predetermined direction.

11. An image forming apparatus comprising:

a photoreceptor;

a main charger for charging a surface of the photoreceptor at a predetermined potential;

a cleaning unit for removing residual toner adhering onto the photoreceptor surface; and a destaticizer for removing electric charges from the photoreceptor surface, the destaticizer being adapted to remove electric charges from the photoreceptor surface by exposing the photoreceptor surface to light, and having a light source and a light guide member for generally uniformly guiding light from the light source to a light exposure area on the photoreceptor;

wherein the light source is adapted to emit two different kinds of light beams, one kind of which has a greater wavelength than the other.

12. An image forming apparatus as set forth in claim 11, wherein the photoreceptor has a photoconductive layer formed of amorphous silicon.

13. An image forming apparatus comprising:

a photoreceptor;

a main charger for charging a surface of the photoreceptor at a predetermined potential;

a cleaning unit for removing residual toner adhering onto the photoreceptor surface; and a destaticizer for removing electric charges from the photoreceptor surface, the destaticizer being adapted to remove electric charges from the photoreceptor surface by exposing the photoreceptor surface to light, and having a light source and a light guide member for generally uniformly guiding light from the light source to a light exposure area on the photoreceptor;

wherein the light source is adapted to emit light including a light component having a wavelength of 650 nm or greater.

14. An image forming apparatus as set forth in claim 13, wherein the photoreceptor has a photoconductive layer formed of amorphous silicon.

* * * * *